US005996333A

United States Patent [19]

Forestier et al.

[11] Patent Number: 5,996,333

[45] Date of Patent: Dec. 7, 1999

[54] OXIDIZER CONTROL DEVICE FOR A GAS TURBINE ENGINE

[75] Inventors: Alexandre Forestier, Boissise la Bertrand; Hernandez Didier Hyppolyte, Quiers, both of France

[73] Assignee: Societe National d'Etude et de Construction de Moteurs d'Aviation

[21] Appl. No.: 08/950,017

[22] Filed: Oct. 14, 1997

[30] Foreign Application Priority Data

Oct. 16, 1996 [FR] France ..... 96 12600

[51] Int. Cl.[6] ..... F23R 3/26

[52] U.S. Cl. ..... 60/39.23; 60/748

[58] Field of Search ..... 60/39.23, 39.29, 60/39.37, 748

[56] References Cited

U.S. PATENT DOCUMENTS 4,726,182 2/1988 Barbier et al. .
5,159,807 11/1992 Forestier .
5,230,212 7/1993 Forestier .

FOREIGN PATENT DOCUMENTS 2 085 147 4/1982 United Kingdom .

*Primary Examiner*—Louis J. Casaregola
*Attorney, Agent, or Firm*—Bacon & Thomas PLLC

[57] ABSTRACT

An oxidizer control device for controlling the amount of oxidizer passing into a combustion chamber of a gas turbine engine. The device has first and second diaphragm assemblies located adjacent to each other at a front portion of the chamber. The first diaphragm assembly has a first, generally annular member with a plurality of circumferentially spaced apart vanes, adjacent vanes forming first oxidizer passageways therebetween, the first passageways opening through a periphery of the first member, and a second generally annular member extending around the periphery of the first member, the second member having a plurality of circumferentially spaced apart first orifices equal in number to the number of first passageways and being fixedly attached to the engine structure. The second diaphragm assembly has a third generally annular member with a plurality of circumferentially spaced apart vanes, adjacent vanes forming second oxidizer passageways therebetween, the second passageways opening through a periphery of the third member, which is fixedly attached to the engine structure and a fourth generally annular member extending around the periphery of the third member, the fourth member having a plurality of circumferentially spaced apart second orifices equal in number to the number of second passageways. An actuator is connected to the first and fourth members of each pair of assemblies so as to simultaneously rotate the first member relative to the second member, and the fourth member relative to the third member, such relative movement opening or closing the first and second oxidizer passageways.

3 Claims, 4 Drawing Sheets

OXIDIZER CONTROL DEVICE FOR A GAS TURBINE ENGINE

BACKGROUND OF THE INVENTION

The present invention relates to a device for controlling the amount of oxidizer passing into the combustion chamber of a gas turbine engine.

It is known to provide gas turbine engines with devices for controlling the amount of oxidizer passing into the gas turbine combustion chamber. Typically, such devices include a plurality of controllable diaphragms arranged in an array around the front end of the combustion chamber and controllable so as to regulate the flow of oxidizer through the devices.

The amount of oxidizer, typically air, passing into the primary combustion zone of a combustion chamber varies widely according to the operating mode and feed conditions of the gas turbine engine. The variations are generally not proportional and cause large deviations in the richness of the air/fuel mixture between the low power and full power operating modes. During low power operation, the air/fuel mixture is lean, while at full power, the mixture is rich.

Oxidizer flow, pressure, temperature and mixture richness are comparatively low during low power operating modes. Consequently, the reaction rates within the combustion chamber are also slow. It is desirable, therefore, when in the low power mode, to restrict the oxidizer flow into the combustion chamber to enrich the air/fuel mixture in the primary combustion zone and to introduce the oxidizer into the combustion chamber at large angles in both the axial and tangential directions in order to achieve a widely distributed air/fuel mixture in order to enhance the dwell time of the gases within the combustion chamber and improve flame stability.

In the full power operating mode, the oxidizer flow, pressure, temperatures and richness of the air/fuel mixture are very high, resulting in high reaction rates. Accordingly, it is desirable to increase oxidizer flow in the primary combustion zone to reduce the richness of the air/fuel mixture and to thereby minimize the production of $NO_x$ and smoke. The air/fuel mixture is introduced into the combustion chamber at small angles in both the axial an d tangential directions thereby reducing recirculation and dwell times and rapidly terminating the reactions following combustion to minimize the combustion of $NO_x$.

In order to accomplish these parameters, it is necessary to modulate the oxidizer flow into the combustion chamber in order to restrict the changes in richness to the primary combustion zone. In a known turbine design, each of the variable diaphragms comprises a set of vanes forming oxidizer intake ducts between them, which ducts pass through a periphery of the diaphragm structure. The diaphragm structure includes a member enclosing a periphery of the set of vanes and having circumferentially spaced apart apertures whereby relative rotation between these elements will bring the apertures into alignment with the ducts, to open the diaphragm and allow the maximum amount of oxidizer, or to move the apertures out of alignment with the ducts, thereby restricting the oxidizer input. It is also known to arrange the diaphragms in adjacent pairs and to utilize a common actuator to regulate both of the diaphragms of the pair. Typical diaphragm control devices are illustrated in French Patents 2,661,714 and 2,676,529.

In French Patent 2,676,529, the control device utilizes adjacent diaphragm assemblies in which the structure having the plurality of vanes extending therefrom and which defines the oxidizer ducts are stationarily attached to a front end portion of the combustion chamber, while the actuator is attached to the movable structure having the apertures and extending around the peripheries of the vane structure. The vane structures are identical in configuration, as are the moveable elements which rotate with respect to each other in opposite directions.

Although this structure has been generally successful, the aerodynamic profiles of the oxidizer ducts of the two diaphragm assemblies are not identical, except when the oxidizer ducts are fully closed or fully open. The lack of identity is caused by the oxidizer ducts of one of the diaphragms being situated on one side of the vane surfaces, whereas in the adjacent diaphragm, the oxidizer passages are situated on an opposite side of the vane surface. Accordingly, the tangential and axial angles of the air flow passing through the two diaphragms will not be identical to each other for a given air flow setting, thereby resulting in a non-homogeneous air/fuel mixture.

SUMMARY OF THE INVENTION

An oxidizer control device is disclosed for controlling the amount of oxidizer passing into a combustion chamber of a gas turbine engine. The device has first and second diaphragm assemblies located adjacent to each other at a front portion of the combustion chamber. A first diaphragm assembly has a first, generally annular member with a plurality of circumferentially spaced apart vanes, adjacent vanes forming first oxidizer passageways between them, the first passageways opening through a periphery of the first member, and a second generally annular member extending around the periphery of the first member, the second member having a plurality of circumferentially spaced apart first orifices equal in number to the number of first passageways, the second member being fixedly attached to the engine structure. The device also includes a second diaphragm assembly having a third generally annular member with a plurality of circumferentially spaced apart vanes, adjacent vanes forming second oxidizer passageway between them, the second passageways opening through a periphery of the third member, which is fixedly attached to the engine structure, and a fourth generally annular member extending around the periphery of the third member, the fourth member having a plurality of circumferentially spaced apart second orifices being equal in number to the number of second passageways. An actuator is connected to the first and fourth annular members of the device so as to simultaneously rotate the first member relative to the second member, and the fourth member relative to the third member, such relative movement opening or closing the first and second oxidizer passageways.

An object of the present invention is to provide an oxidizer control device that achieves homogeneity of the air/fuel mixture for all of the fuel injectors of the combustion chamber.

It is a further object of the invention to provide an oxidizer control device having a pair of diaphragm assemblies in which the geometry of the oxidizer passageways remains constant throughout the full range of adjustment of the diaphragm assemblies.

DETAILED DESCRIPTION OF THE PREFERRED EMBODIMENT

Figure 1:
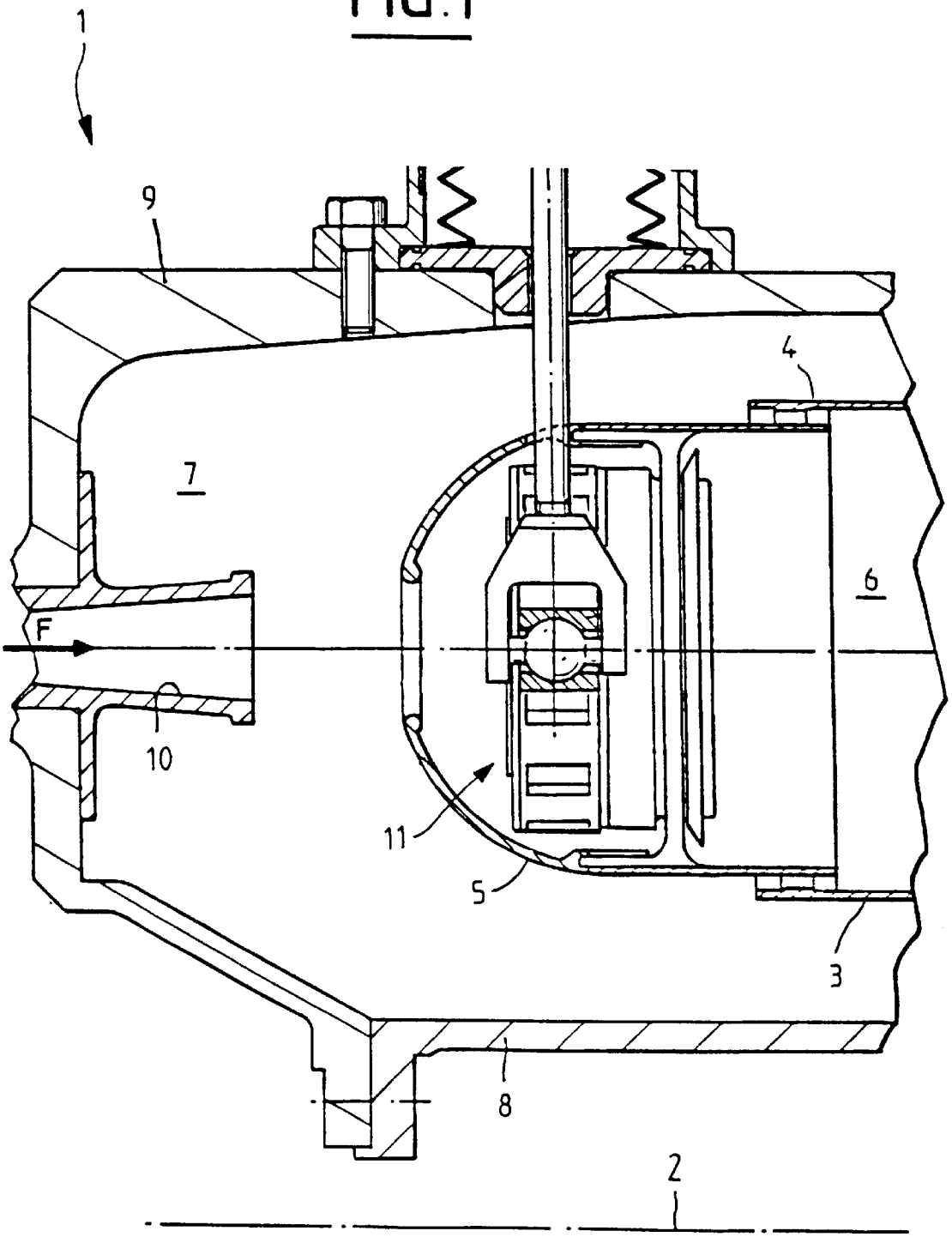
FIG. 1 is a partial, cross-sectional view of an annular combustion chamber including the oxidizer control device according to the present invention.

A combustor 1 is illustrated in FIG. 1 and is of the annular type extending about central axis 2 such as that utilized in a typical aircraft turbojet engine. The combustor has a combustion chamber 6 which is bounded by an inner wall 3 and an outer wall 4 both of which are annular and extend about axis 2 and which are connected at a front end by chamber end 5. The combustion chamber is contained within a space 7 bounded by an inner casing 8 and an outer casing 9, again, both being annular and extending about longitudinal axis 2. In known fashion, the space 7 is supplied with a pressurized oxidizer, typically air, from a compressor (not shown) through an oxidizer intake orifice 10. The pressurized oxidizer passes into the space 7 in the direction of arrow F. In known fashion, a fuel injector (not shown) is associated with an oxidizer control device 11 so as to inject fuel into the combustion chamber 6.

The oxidizer control device 11 is formed by adjacent diaphram assemblies 11*a*, 11*b* which are arrayed in a of the pair 20. Each diaphram assembly 11*a*, 11*b* comprises a generally annular member 12 having a plurality of vanes 19*a* extending therefrom such that adjacent pairs of vanes 19*a* form oxidizer passageways 13 therebetween, each of the oxidizer passageways 13 opening through the outer periphery of the member 12 by apertures 15. Each diaphram assembly 11*a*, 11*b* further comprises a member 16 having a portion extending around the outer periphery of the associated member 12 and having a plurality of orifices 17 being equal in number to the number of passageways formed in the associated member 12. The orifices 17 may be moved into alignment with the apertures 15 of the associated member 12, or may be moved out of alignment therewith so as to open and close the oxidizer passageways 13. Relative movement between the member 12 and the associated member 16 enables the opening and closing of the oxidizer passageways 13. The plurality of orifices 17 are circumferentially spaced around the member 16 and are separated by wall portions 18.

The diaphram assemblies 11*a*, 11*b* are arranged in an array around the forward portion of the combustion chamber and are arranged in adjacent pairs which are controlled by a single actuating device.

Figure 2:
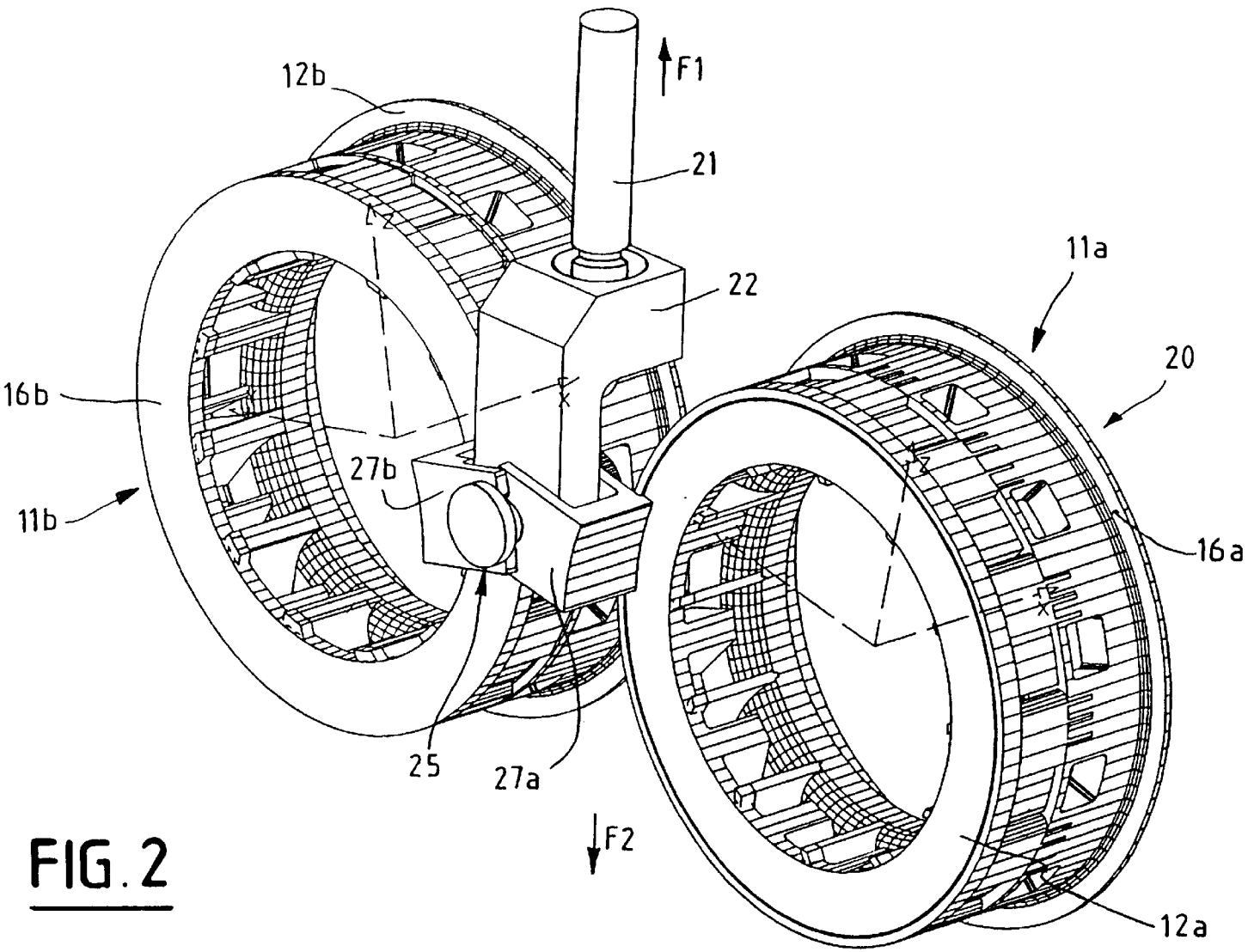
FIG. 2 is a perspective view of adjacent diaphragm assemblies of the oxidizer control device according to the present invention.

The oxidizer flow into the combustion chamber of the two adjacent diaphram assemblies 11*a*, 11*b* is regulated by movement of control rod 21 in the direction of arrows F1 or F2, as best illustrated in FIG. 2. The control rod 21 is connected to a bracket 22 having at its lower end, bore 23 housing a swivel connection 24. The swivel connection 24 is affixed to a shaft 25 which is mounted in aligned pairs of notches 26*a*, 26*b* of connecting brackets 27*a* and 27*b* which are, in turn, attached to the movable elements of the diaphram assemblies 11*a* and 11*b*.

Figure 3:
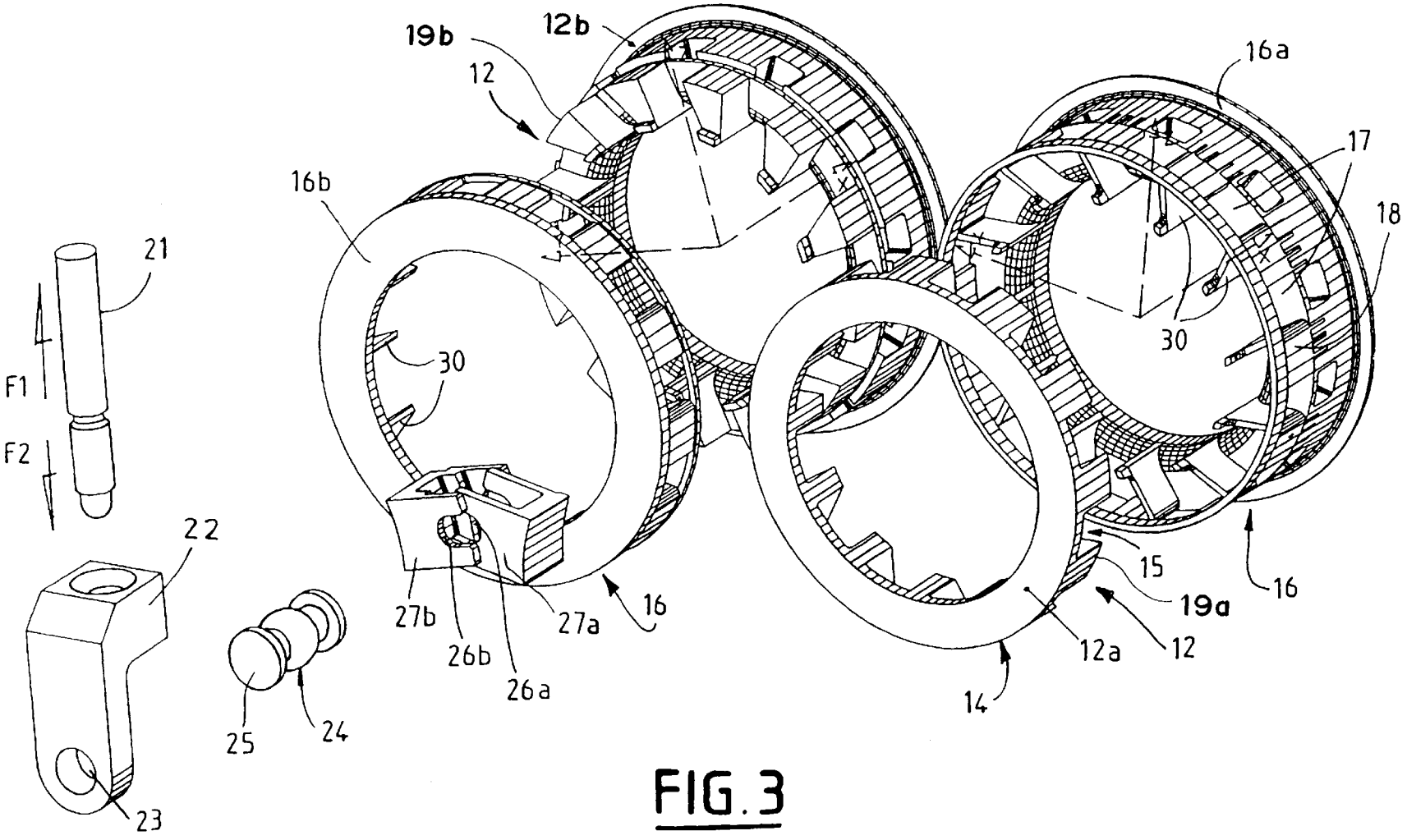
FIG. 3 is an exploded view of the assembly of FIG. 2.

According to the present invention, the bracket 27*a* is connected to the member 12*a* having the vanes 19*a* thereon of the diaphragm assembly 11*a*, while the connecting bracket 27*b* is connected to member 16*b* having the opening and closing orifices 17 of the diaphragm assembly 11*b*. As clearly illustrated in FIG. 3, the two vane arrays 19*a* and 19*b* are different from each other, and the two control members 16*a* and 16*b* are also different from each other.

Figure 4:
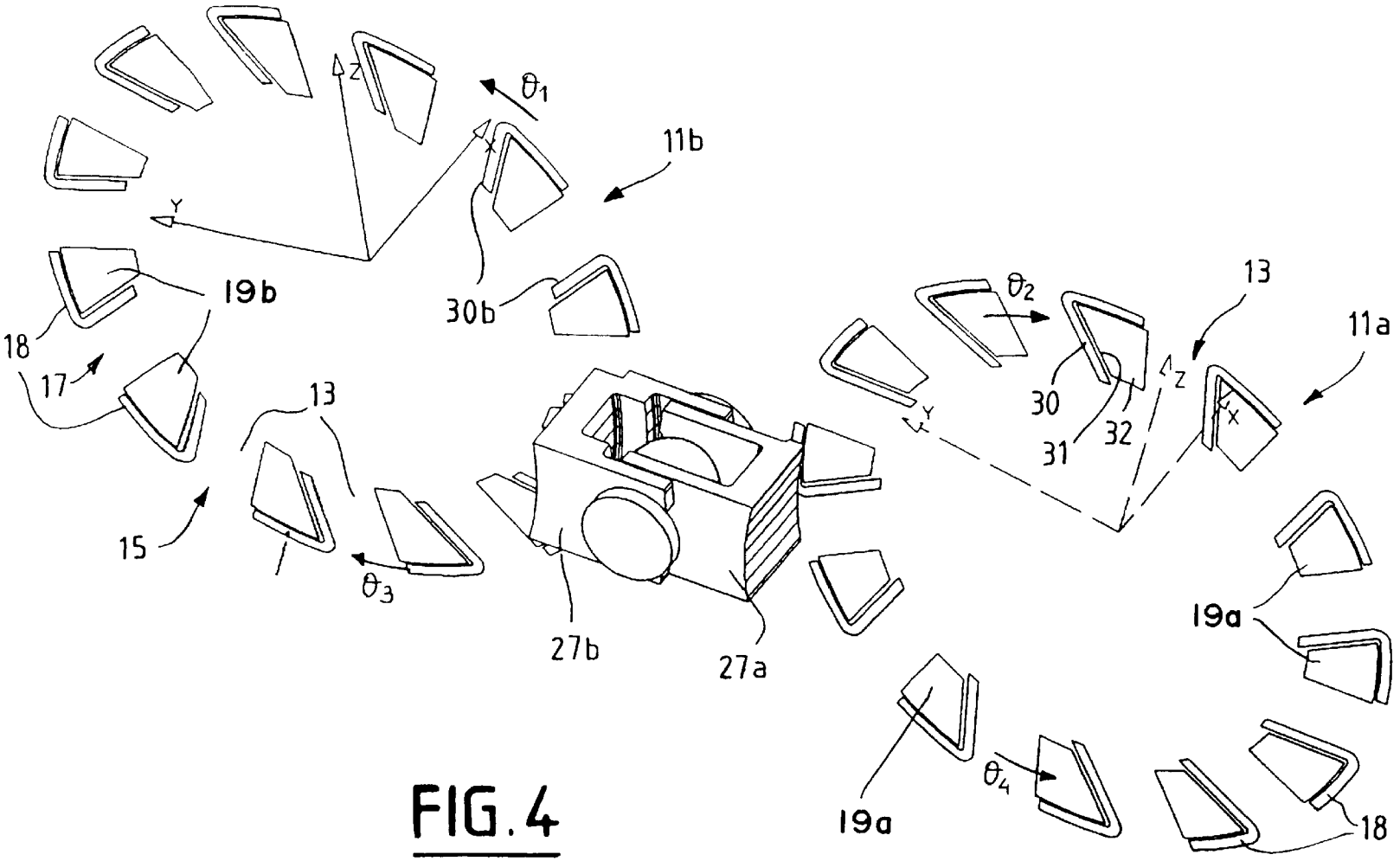
FIG. 4 is a schematic diagram illustrating the geometry of the oxidizer passageways of the present invention.

The control members 16*a* and 16*b* may also comprise a plurality of guide tabs 30 located such that a guide tab extends into each of the oxidizer passageways and makes contact with the surfaces 31 of the vanes, as illustrated in FIG. 4. Such contact takes place when the oxidizer passageways are fully opened.

As illustrated in FIG. 4, the oxidizer passageways 13 of the associated control devices 11*a* and 11*b* slope in the same direction in order that the oxidizer flow passing through into the combustion chamber win also swirl in the same directions.

Starting with the configuration as illustrated in FIG. 4, if the control rod is displaced upwardly in the direction of arrow F1, connecting bracket 27*a* will rotate the member 12*a* in the direction of arrow θ2, while the bracket 27*b* will rotate member 16*b* in an opposite direction, in the direction of arrow θ1. The angular displacements of the members 12*a* and 16*b* are equal in magnitude, but opposite in direction. Because of this displacement, the cross-sections of the oxidizer passageways 13 decrease in equal amounts and with identical geometries in the two oxidizer control devices 11*a* and 11*b*.

If the control rod is moved downwardly in the direction of arrow F2, the bracket 27*a* rotates the member 12*a* in the direction of arrow θ4 and the connecting bracket 27*b* will rotate the member 16*b* in the direction of arrow θ3. Again, the angular displacements of these elements are equal in magnitude but opposite in direction. Again, the cross-sections of the oxidizer passageways 13 will increase in both oxidizer control devices 11*a* and 11*b* with their cross-sections and geometries being identical throughout the full range of movement.

The foregoing description is provided for illustrative purposes only and should note be construed as in any way limited this invention, the scope of which is defined solely by the appended claims.

We claim:

1. An oxidizer control device for controlling the amount of oxidizer passing into a combustion chamber of a gas turbine engine, the oxidizer control device comprising:

a) a first diaphragm assembly having:

i) a first generally annular member with a plurality of circumferentially spaced apart vanes thereon, adjacent vanes forming first oxidizer passageways therebetween, the first passageways opening through a periphery of the first member; and, ii) a second generally annular member extending around the periphery of the first member, the second member having a plurality of circumferentially spaced apart first orifices equal in number to the number of first passageways, the second member being fixedly attached to the engine;

b) a second diaphragm assembly having:

i) a third generally annular member with a plurality of circumferentially spaced apart vanes thereon, adjacent vanes forming second oxidizer passageways therebetween, the second passageways opening through a periphery of the third member, the third member being fixedly attached to the engine; and ii) a fourth generally annular member extending around the periphery of the third member, the fourth member having a plurality of circumferentially spaced apart second orifices equal in number to the number of second passageways; and, c) an actuator connected to the first and fourth members so as to simultaneously rotate the first member relative to the second member and the fourth member relative to the third member, such relative movement opening and closing the first and second oxidizer passageways.

2. The oxidizer control device of claim 1 wherein the second and third members are fixedly attached to a forward end wall of the combustion chamber.

3. The oxidizer control device of claim 1, further comprising:

a plurality of guide tabs extending from the second and third members, one of the guide tabs extending into each of the first and second oxidizer passageways.

* * * * *

UNITED STATES PATENT AND TRADEMARK OFFICE

CERTIFICATE OF CORRECTION

PATENT NO. : 5,996,333

DATED : December 7, 1999

INVENTOR(S) : Alexandre FORESTIER et al.

It is certified that error appears in the above-indentified patent and that said Letters Patent is hereby corrected as shown below:

Cover page, Item [75]; change "Hernandez Didier Hyppolyte," to --Didier Hyppolyte Hernandez,--

Column 3, line 25, delete "of the"

Signed and Sealed this

Twenty-third Day of January, 2001

*Attest:*

*Attesting Officer*

Q. TODD DICKINSON

*Commissioner of Patents and Trademarks*